US010711226B2

(12) United States Patent
Puukilainen

(10) Patent No.: US 10,711,226 B2
(45) Date of Patent: Jul. 14, 2020

(54) COMPOSITION FOR CLEANING SKIN STRIPS OF SKIN SKIS

(71) Applicant: VAUHTI SPEED OY, Joensuu (FI)

(72) Inventor: Esa Puukilainen, Joensuu (FI)

(73) Assignee: VAUHTI SPEED OY, Joensuu (FI)

( * ) Notice: Subject to any disclaimer, the term of this patent is extended or adjusted under 35 U.S.C. 154(b) by 0 days.

(21) Appl. No.: 15/999,833

(22) PCT Filed: Feb. 16, 2017

(86) PCT No.: PCT/FI2017/050095
§ 371 (c)(1),
(2) Date: Aug. 20, 2018

(87) PCT Pub. No.: WO2017/140951
PCT Pub. Date: Aug. 24, 2017

(65) Prior Publication Data

US 2019/0194581 A1 Jun. 27, 2019

(30) Foreign Application Priority Data

Feb. 18, 2016 (FI) ..... 20165122

(51) Int. Cl.

| | |
|---|---|
| ***C11D 1/72*** | (2006.01) |
| ***C11D 3/30*** | (2006.01) |
| ***C11D 7/26*** | (2006.01) |
| ***B08B 3/04*** | (2006.01) |
| ***A63C 7/02*** | (2006.01) |
| ***C11D 11/00*** | (2006.01) |
| ***C11D 7/32*** | (2006.01) |

(52) U.S. Cl.
CPC ..... *C11D 11/0017* (2013.01); *C11D 7/26* (2013.01); *C11D 7/261* (2013.01); *C11D 7/263* (2013.01); *C11D 7/266* (2013.01); *C11D 7/32* (2013.01); *C11D 7/3218* (2013.01); *A63C 7/02* (2013.01)

(58) Field of Classification Search
CPC ..... C11D 1/72; C11D 3/2006; C11D 3/2093; C11D 3/30; C11D 7/26; C11D 7/266; C11D 7/3218; B08B 3/04; A63C 7/02
See application file for complete search history.

(56) References Cited

U.S. PATENT DOCUMENTS

| | | | | |
|---|---|---|---|---|
| 4,659,498 | A | 4/1987 | Stoufer | |
| 5,712,237 | A | 1/1998 | Stevens | |
| 6,511,547 | B1 | 1/2003 | Sahbari | |
| 2007/0225179 | A1 * | 9/2007 | Schutz | C09G 3/00 508/207 |
| 2009/0281012 | A1 | 11/2009 | Trivedi et al. | |

FOREIGN PATENT DOCUMENTS

| | | |
|---|---|---|
| AU | 2015203500 | 1/2016 |
| CN | 102690551 | 9/2012 |
| CN | 102533475 | 4/2013 |
| CN | 103937627 | 7/2014 |
| CN | 103952243 | 7/2014 |
| DE | 0153 889 | 2/1982 |
| FR | 2 544 729 | 10/1984 |
| JP | 2004-262816 | 9/2004 |
| JP | 2007-163528 | 6/2007 |
| JP | 4851177 | 1/2012 |
| WO | 2015/192184 | 12/2015 |

OTHER PUBLICATIONS

International Search Report for PCT/FI2017/050095, dated Jun. 16, 2017, 5 pages.
Search report for FI 20165122, dated Sep. 19, 2016, 3 pages.
International Preliminary Report on Patentability with Amended Sheets for PCT/FI2017/050095 dated May 7, 2018, 12 pages.
Toko Raching Waxremover [revision date May 6, 2013] [retrieved Aug. 11, 2016, from internet]: http://www.toko.ch/en/products/tools/base-tuning, 3 pages.

* cited by examiner

*Primary Examiner* — Brian P Mruk
(74) *Attorney, Agent, or Firm* — Nixon & Vanderhye P.C.

(57) ABSTRACT

Provided herein is a composition for cleaning skin strips of skin skis, in particular for removing hydrophobic compounds, such as oils, resins, grease, and/or waxes, from the surface of the skin strips. The composition comprises (a) $C_{1-6}$-alcohol; (b) at least 10% by weight of the total weight of the composition of dibasic ester(s) of formula $R^1O—C(O)—(CH_2)_n—C(O)—OR^1$, wherein n is 2 to 4; and each $R^1$ is independently $C_{1-6}$-alkyl, (c) 0 to 5% by weight of the total weight of the composition of alkoxyalkanol(s) of formula $R^2O—(CH_2)_m—OH$ wherein m is 1 to 4, preferably 2 or 3, and $R^2$ is $C_{1-6}$-alkyl, preferably $C_{3-6}$-alkyl; and (d) 0 to 5% by weight of the total weight of the composition of tri($C_{1-6}$-alkanol) amine(s).

9 Claims, No Drawings

COMPOSITION FOR CLEANING SKIN STRIPS OF SKIN SKIS

This application is the U.S. national phase of International Application No. PCT/FI2017/050095 filed 16 Feb. 2017 which designated the U.S. and claims priority to FI Patent Application No. 20165122 filed 18 Feb. 2016, the entire contents of each of which are hereby incorporated by reference.

FIELD OF THE INVENTION

The present invention relates to a composition for cleaning skin strips of skin skis, and more particularly to a composition free of any aliphatic and/or aromatic hydrocarbons for removing hydrophobic compounds such as oils, resins, grease, and/or waxes from the surface of skin strips.

BACKGROUND OF THE INVENTION

Skin strips, also referred to as climbing skins or ski skins, are strips that attach to the bottom of Nordic and Alpine skis to provide grip. To provide waxless skis skin strips are typically attached to the kick zone of the skis with an adhesive on the ski base thus providing skin skis. They are called skins because they resemble sealskin and are designed to let the ski slide forward on snow but not backward and to provide solid grip. They are typically made from mohair or nylon or a combination thereof. They may also be coated with e.g. teflon.

The skin strip surface should be cleaned periodically to provide sufficient grip and smooth forward slide. Typical compositions marketed for cleaning ski bases consist of or contain major amounts aliphatic hydrocarbon solvents such as heptane. Cleaning composition based on aliphatic and/or aromatic hydrocarbons unfortunately dissolves the adhesive attaching the skin strips to the ski base and when employed for cleaning skin strips leads to detachment of the skin strip from the ski base. This naturally leads to the damage of the ski.

U.S. Pat. No. 5,712,237 discloses a composition for use in cleaning or degreasing composition for removing contaminants from textiles such as curtains.

CN 102533475 discloses a mobile phone touch screen cleaner composition.

AU 2015203500 discloses a nail polish remover composition.

WO 2015192184 discloses a composition for removing graffiti.

CN 102690551 discloses a paint remover composition.

CN 103952243 discloses a circuit plate removing residue cleaning composition.

JP 2007163528 discloses a toner wet fixing agent.

U.S. Pat. No. 6,511,547 discloses a photoresist stripping composition.

BRIEF DESCRIPTION OF THE INVENTION

An object of the present invention is thus to provide a composition for cleaning skin strips of skin skis so as to overcome the above problems. The objects of the invention are achieved by a composition, use thereof and a method, which are characterized by what is stated in the independent claims. The preferred embodiments of the invention are disclosed in the dependent claims.

The invention is based on the realization that a composition comprising (a) alcohol(s) and (b) dibasic ester(s) and being substantially free of any aliphatic and aromatic hydrocarbon solvents avoids detachment of the skin strips from the ski base but removes any build-up dirt such as those selected from oils, resins, grease, and waxes from the surface of the skin strip.

DETAILED DESCRIPTION OF THE INVENTION

Provided herein is a composition comprising (a) $C_{1-6}$-alcohol;

(b) at least 10% by weight of the total weight of the composition of dibasic ester(s) of formula (I)

$$R^1O—C(O)—(CH_2)_n—C(O)—OR^1 \quad (I)$$

wherein n is 2 to 4; and each $R^1$ is independently $C_{1-6}$-alkyl;

(c) 0 to 5% by weight of the total weight of the composition of alkoxyalkanol(s) of formula (II)

$$R^2O—(CH_2)_m—OH \quad (II)$$

wherein m is 1 to 4, and $R^2$ is $C_{1-6}$-alkyl; and (d) 0 to 5% by weight of the total weight of the composition of tri($C_{1-6}$-alkanol)amine(s), for cleaning skin strips.

Further provided herein is use of a composition comprising (a) $C_{1-6}$-alcohol; and (b) at least 10% by weight of the total weight of the composition of dibasic ester(s) of formula (I)

$$R^1O—C(O)—(CH_2)_n—C(O)—OR^1 \quad (I)$$

wherein n is 2 to 4; and each $R^1$ is independently $C_{1-6}$-alkyl;

for cleaning skin strips, in particular for removing hydrophobic compounds, such as oils, resins, grease, and/or waxes, from the surface of the skin strips.

The term "skin strip" refers to strips that may be attached to the bottom of Nordic or Alpine skis to provide grip, in particularly to strips attached to the kick zone of the skis with an adhesive on the ski base. The said skin strips are preferably comprised from mohair, nylon or a combination thereof. They may also be coated with e.g. teflon.

The term "comprise" as used herein and hereafter describes the constituents of the present composition in a non-limiting manner i.e. the present composition comprising defined constituents consists, at least, of the said constituents, but may additionally, when desired, comprise other constituents. However, the present composition comprising defined constituents may consist of only the said constituents. The term "comprise" is further used to reflect that the present composition may comprise trace amounts of other materials or impurities, or both, which do not alter the effectiveness of the present composition.

The present composition preferably does not comprise aliphatic and aromatic hydrocarbon solvents as their presence even in small amounts could lead to detachment of the skin strip from the base of the ski.

The present composition comprises (a) $C_{1-6}$-alcohol(s), preferably $C_{2-4}$-alcohol(s) as a solvent. The term "$C_{1-6}$-alcohol" refers to alcohols comprising a $C_{1-6}$-alkyl group and a OH-group attached to the alkyl group. The $C_1$-$C_6$-alkyl group of the $C_{1-6}$-alcohol may be linear or branched.

Examples of $C_{1-6}$-alcohol(s) include methanol, ethanol, n-propanol, i-propanol, n-butanol, i-butanol, t-butanol, pentanol, hexanol, etc. Preferably (a) the $C_{1-6}$-alcohol is selected from a group consisting of ethanol, propanol, and any mixtures thereof.

The above described (a) $C_{1-6}$-alcohol(s) are typically present in the composition in an amount from 60 to 90% by weight, preferably from 70 to 85% by weight, of the total weight of the composition. The amount of (a) is dependent of the amount of the other components in the present composition. Most preferably the amount of (a) is 80% by weight of the total weight of the composition.

The present composition also comprises (b) dibasic ester(s) of formula (I). Preferably the ester parts the dibasic ester(s) are derived from methanol (i.e. $R_1$ is methyl) thus providing dibasic methyl esters. However, also esters with longer alkyl chains can be employed. The acid core of the dibasic ester(s) is preferably derived from a linear $C_{2-4}$-dicarboxylic acid (i.e. n is 2 to 4). Preferably the dibasic ester(s) of formula (I) (b) are selected from a group consisting of dimethyl succinate, dimethyl glutarate, dimethyl adipate, and any mixtures thereof.

The above described dibasic ester(s) of formula (I) (b) are typically present in the composition in an amount from 10 to 30% by weight of the total weight of the composition. The amount of (b) must be sufficient to provide effective cleaning of the skin strips. Preferably the amount of (b) is 12 to 25% by weight, more preferably 15 to 20% by weight, of the total weight of the composition.

In addition to (a) alcohol(s) and (b) dibasic ester(s) the present composition advantageously comprises (c) up to 5% by weight of the total weight of the composition of alkoxyalkanol(s) of formula (II)

$$R^2O—(CH_2)_m—OH \quad (II)$$

wherein m is 1 to 4, preferably 2 or 3, and $R^2$ is $C_{1-6}$-alkyl, preferably $C_{3-6}$-alkyl;

and/or (d) up to 5% by weight of the total weight of the composition of tri($C_{1-6}$-alkanol)amine(s), preferably tri($C_{2-4}$-alkanol)amine(s).

Preferably both alkoxyalkanol(s) (c) and tri($C_{1-6}$-alkanol) amine(s) (d) are present in the present composition.

Alkoxyalkanols of formula (II) (c) are particularly advantageous component of the present composition as they dissolve both water-soluble and hydrophobic substances. Thus their presence improves removal of build up dirt from the surface of the skin strips. The amount of alkoxyalkanol(s) (c) in the present composition is preferably from 1 to 5% by weight, more preferably 1.5 to 3% by weight, most preferably 2% by weight, of the total weight of the composition. Preferably the alkoxyalkanol of formula (II) (c) is butoxyethanol.

The present composition may also comprise (d) tri($C_{1-6}$-alkanol)amine(s), preferably tri($C_{2-4}$-alkanol)amine(s). The term "tri($C_{1-6}$-alkanol)amine" refers to tertiary amines, wherein the nitrogen is substituted with three $C_{1-6}$-alkanol groups. The term "$C_{1-6}$-alkanol" further refers to HO-substituted $C_{1-6}$-alkyl groups, in particularly to groups having formula —$(CH_2)_{1-6}$—OH. The presence of (d) adjusts and buffers the pH of the present composition, and helps to dissolve oils, waxes and other impurities on the skin strips that are not completely soluble in water. The amount of tri($C_{1-6}$-alkanol)amine(s) (d) in the present composition is preferably from 0.2 to 5% by weight, more preferably 0.5 to 2% by weight, most preferably 1% by weight, of the total weight of the composition. Preferably the tri($C_{1-6}$-alkanol) amine (d) is triethanolamine.

Most preferably the present composition is a composition comprising (a) $C_{1-6}$-alcohol(s), wherein the $C_{1-6}$-alcohol is selected from a group consisting of ethanol, propanol and any mixtures thereof;

(b) 10 to 30% by weight of the total weight of the composition of dibasic ester(s) of formula (I), wherein the dibasic ester(s) of formula (I) are selected from a group consisting of dimethyl succinate, dimethyl glutarate, dimethyl adipate, and any mixtures thereof;

(c) up to 5% by weight of the total weight of the composition of alkoxyalkanol(s) of formula (II), wherein (c) the alkoxyalkanol of formula (II) is butoxyethanol; and (d) up to 5% by weight of the total weight of the composition of tri($C_{1-6}$-alkanol)amine(s), wherein the tri ($C_{1-6}$-alkanol)amine is triethanolamine.

Provided herein is also a method for cleaning skin strips, in particular for removing hydrophobic compounds such as oils, resins, grease, and/or waxes from a surface of a skin strip, comprising contacting the surface of a skin strip with the present composition.

The present composition may be used for cleaning of skin strips as such. The present composition is obtained by mixing the components of the composition. It may for example be provided in any suitable container, for example a container comprising a nozzle for pouring the composition from the container directly onto the skin strip surface. The composition is then preferably spread and rubbed on the whole surface of the skin strip with a clean cloth until any build-up dirt has been removed. The present composition may also be provided in a spray bottle to be sprayed on the surface of the skin strips. Alternatively the present composition may be provided in a form of a disposable cloth into which the composition has been adsorbed in an amount that is effective for cleaning the surface of a skin strip. The disposable cloth is preferably suitably packed to prevent evaporation of the present composition prior to use.

Further provided herein is a kit for maintenance of skin strips, comprising a container or disposable cloth(s) comprising the present composition. When the kit comprises a container comprising the present composition it preferably further comprises a cloth for spreading the composition on the surface of a skin strip. The container comprising the present composition preferably comprises a nozzle for pouring the present composition from the container directly onto the surface of the skin strip. The present kit may further comprise a second container or second disposable cloth(s) comprising a composition for improving the gliding properties of the skin strips on snow.

EXAMPLES

Example 1. Composition 1

80% by weight of ethanol
17% by weight of a mixture of
dimethyl succinate
dimethyl glutarate, and
dimethyl adipate
2% by weight of ethylene glycol butyl ether
1% by weight of triethanolamine.

Example 2. Reference Composition 2

90% by weight of ethanol
8.5% by weight of a mixture of
dimethyl succinate
dimethyl glutarate, and
dimethyl adipate
1% by weight of ethylene glycol butyl ether
0.5% by weight of triethanolamine.

The compositions 1 and 2 were obtained by mixing the above indicated components and tested for cleaning efficiency in removal of build-up dirt from a skin strip. Two skin strips attached to ski bases were deliberately contaminated with ski wax. The above described compositions were applied on the surface of different skin strips by pouring the respective composition from a container equipped with a nozzle onto the skin strip and spread and rubbed on the whole surface of the skin strip with a clean cloth. It could be seen that the ski wax was removed from the surface of the skin strip treated with Composition 1 without detaching the skin strip from the ski base. However, ski wax was not sufficiently removed from the from the surface of the skin strip treated with Composition 2 although also in this case the skin strip was not detached from the ski base.

It will be obvious to a person skilled in the art that, as the technology advances, the inventive concept can be implemented in various ways. The invention and its embodiments are not limited to the examples described above but may vary within the scope of the claims.

The invention claimed is:

1. A method for cleaning skin strips of skin skis comprising contacting a surface of a skin strip with a composition comprising (a) $C_{1-6}$-alcohol;

(b) at least 10% by weight of the total weight of the composition of dibasic ester of formula (I)

$$R^1O—C(O)—(CH_2)_n—C(O)—OR^1 \quad (I)$$

wherein n is 2-4; and each $R^1$ is independently $C_{1-6}$-alkyl;

(c) 0 to 5% by weight of the total weight of the composition of alkoxyalkanol of formula (II)

$$R^2O—(CH_2)_m—OH \quad (II)$$

wherein m is 1 to 4, and $R^2$ is $C_{1-6}$-alkyl; and (d) 0 to 5% by weight of the total weight of the composition of tri($C_{1-6}$-alkanol)amine.

2. The method as claimed in claim 1, wherein (c) the alkoxyalkanol of formula (II) is butoxyethanol.

3. The method as claimed in claim 1, wherein (d) the tri($C_{1-6}$-alkanol)amine is triethanolamine.

4. The method as claimed in claim 1, wherein (a) the $C_{1-6}$-alcohol is selected from the group consisting of ethanol, propanol, and mixtures thereof.

5. The method as claimed in claim 1, wherein (b) the dibasic ester of formula (I) is selected from the group consisting of dimethyl succinate, dimethyl glutarate, dimethyl adipate, and mixtures thereof.

6. The method as claimed in claim 1, wherein m is 2 or 3.

7. The method as claimed in claim 1, wherein $R^2$ is $C_{3-6}$-alkyl.

8. The method as claimed in claim 1, wherein the method comprises removing hydrophobic compounds from the surface of the skin strip.

9. The method as claimed in claim 1, wherein the method comprises removing oils, resins, grease, and/or waxes from the surface of the skin strip.

* * * * *